US007857588B2

(12) United States Patent
Propheter-Hinckley et al.

(10) Patent No.: US 7,857,588 B2
(45) Date of Patent: Dec. 28, 2010

(54) REINFORCED AIRFOILS

(75) Inventors: Tracy A. Propheter-Hinckley, Manchester, CT (US); Edward F. Pietraszkiewicz, Southington, CT (US); Steven Bruce Gautschi, Naugatuck, CT (US)

(73) Assignee: United Technologies Corporation, Hartford, CT (US)

( * ) Notice: Subject to any disclaimer, the term of this patent is extended or adjusted under 35 U.S.C. 154(b) by 776 days.

(21) Appl. No.: 11/774,151

(22) Filed: Jul. 6, 2007

(65) Prior Publication Data

US 2009/0010765 A1 Jan. 8, 2009

(51) Int. Cl.
*F01D 5/18* (2006.01)

(52) U.S. Cl. ..... 416/96 A; 416/233

(58) Field of Classification Search ..... 416/96 A, 416/DIG. 3, 232, 233; 29/889.722; 244/123.4
See application file for complete search history.

(56) References Cited

U.S. PATENT DOCUMENTS 2,458,975 A * 1/1949 Brady ..... 416/232
3,627,443 A * 12/1971 Pirzer ..... 416/233
3,628,880 A * 12/1971 Smuland et al. ..... 416/96 A
4,257,734 A * 3/1981 Guy et al. ..... 416/96 A
5,232,344 A 8/1993 El-Aini
5,253,824 A * 10/1993 Halila et al. ..... 416/233
5,509,783 A 4/1996 Jones
5,695,321 A * 12/1997 Kercher ..... 416/96 A
5,820,336 A * 10/1998 Hashimoto ..... 416/95
5,873,699 A 2/1999 Watson et al.
5,993,155 A 11/1999 Endres et al.
6,048,174 A 4/2000 Samit et al.
6,290,462 B1 9/2001 Ishiguro et al.
6,318,963 B1 11/2001 Emery et al.
6,638,012 B2 10/2003 Bekrenev
6,769,875 B2 * 8/2004 Tiemann ..... 416/233
7,001,150 B2 2/2006 Fett et al.
7,033,131 B2 4/2006 Schreiber
7,192,250 B2 3/2007 Boury et al.
7,216,694 B2 5/2007 Otero et al.
2003/0049125 A1 * 3/2003 Bolms et al. ..... 416/97 R

* cited by examiner

*Primary Examiner*—Richard Edgar
(74) *Attorney, Agent, or Firm*—Carlson, Gaskey & Olds P.C.

(57) ABSTRACT

A reinforced airfoil includes an airfoil body including opposed walls that define a hollow interior space and a reinforcement member provided on at least one of the walls within the interior space, the reinforcement member increasing the thickness of the at least one wall so as to resist deformation of the at least one wall but not extending from one wall to the other.

20 Claims, 7 Drawing Sheets

REINFORCED AIRFOILS

STATEMENT REGARDING FEDERALLY SPONSORED RESEARCH AND DEVELOPMENT

The U.S. Government may have an interest in the subject matter of this disclosure as provided for by the terms of contract number N00019-02-C3003 awarded by the United States Air Force.

BACKGROUND

1. Field of the Invention

The present disclosure generally relates to airfoils.

2. Description of the Related Art

Multiple airfoils are typically used within turbine engines. For example, engine stators include a plurality of stationary or variable vanes having an airfoil shape.

During use in engines, such airfoils can experience airfoil bulge, a condition in which the opposed walls of the airfoil expand outward into the engine gas path due to the high temperatures in which the airfoils are used and/or the pressure difference between the interior and the exterior of the airfoils. Such bulge deforms the airfoils so as to temporarily or permanently alter their aerodynamic properties, which can significantly reduce the aerodynamic efficiency of the engine. In extreme cases, airfoil bulge can lead to airfoil rupture, which can cause substantial damage to the engine.

Prior solutions to airfoil bulge have included the provision of auxiliary longitudinal ribs within the airfoil that extend along the length of the airfoil and connect the opposed walls of the airfoil. Although such additional ribs are effective in reducing airfoil bulge, such a solution increases the number of internal surfaces of the airfoil and therefore the difficulty in cooling the airfoil. In addition, the additional use of ribs can increase the difficulty in providing baffles within the airfoils that control the flow of cooling air through the airfoils. Furthermore, the addition of ribs can significantly increase, the weight of the airfoils, and therefore the engine in which they are used.

SUMMARY

In one embodiment, a reinforced airfoil comprises an airfoil body including opposed walls defining a hollow interior space, and a reinforcement member provided on at least one of the walls within the interior space, the reinforcement member increasing the thickness of the at least one wall so as to resist deformation of the at least one wall but not extending from one wall to the other.

BRIEF DESCRIPTION OF THE DRAWINGS

The disclosed airfoils can be better understood with reference to the following drawings. The components in the drawings are not necessarily to scale.

DETAILED DESCRIPTION

As described in the foregoing, airfoil bulge can have detrimental effects on the operation and condition of a turbine engine. Although the use of auxiliary longitudinal ribs can reduce airfoil bulge, the use of such ribs creates difficulties in relation to airfoil cooling and can undesirably increase the weight of the airfoils and the engines in which they are used. As described in the following, however, airfoil bulge can be reduced or avoided without use of longitudinal ribs through use of reinforcement members that are provided on the inner surfaces of the airfoil walls.

Described in the following are reinforced airfoils. Although specific embodiments are presented, those embodiments are mere example implementations and it is noted that other embodiments are possible. All such embodiments are intended to fall within the scope of this disclosure.

Figure 1:
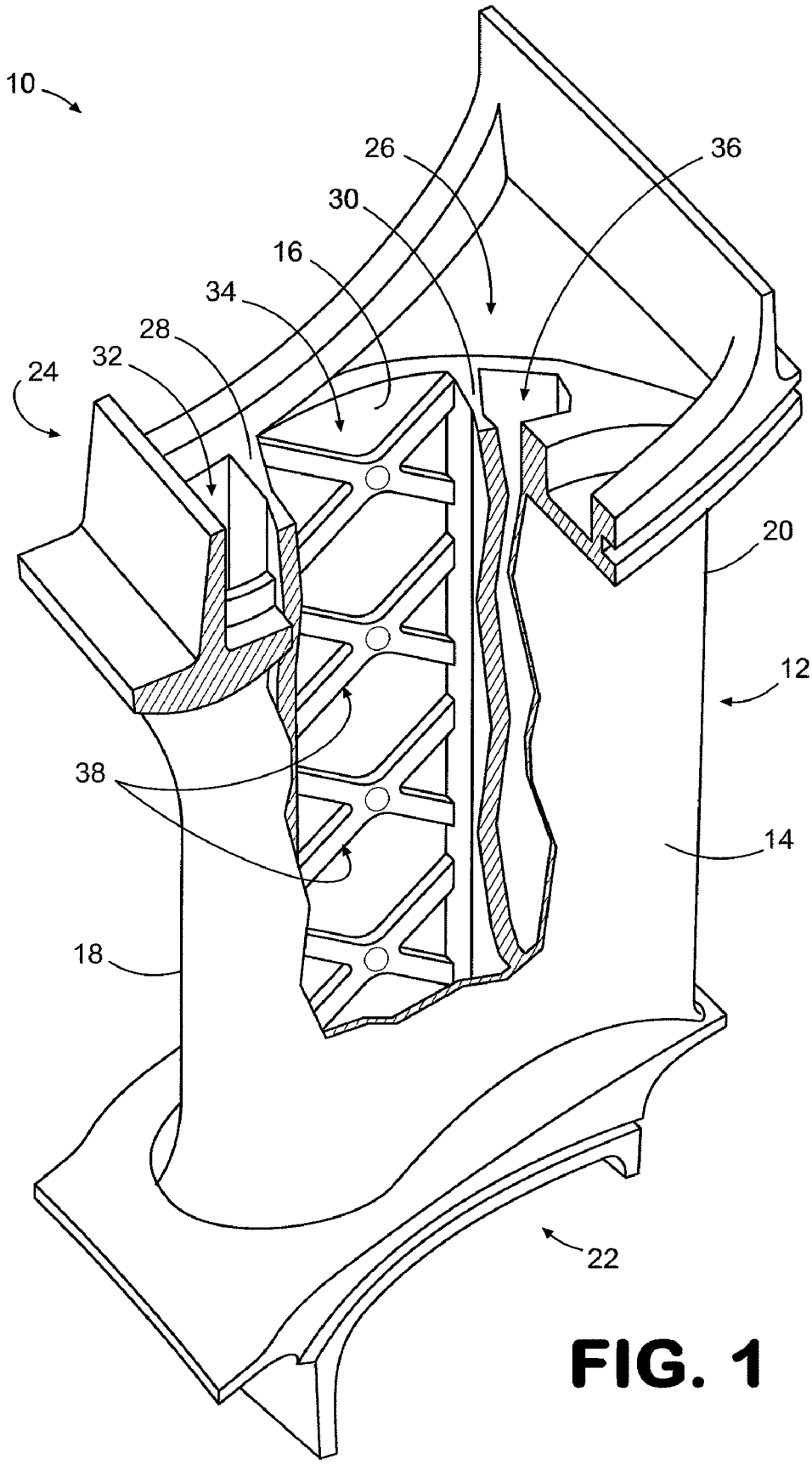
FIG. 1 is a cutaway perspective view an embodiment of a reinforced airfoil.

Turning to the figures, in which like numerals identify corresponding components, FIG. 1 illustrates an embodiment of a reinforced airfoil 10 in perspective view. In some embodiments, the airfoil 10 comprises a stator vane used in a turbine engine. In other embodiments, the airfoil 10 comprises a turbine blade. As indicated in FIG. 1, the airfoil 10 generally comprises an airfoil body 12 that comprises opposed first and second walls 14 and 16. In some embodiments, the first wall 14 is a pressure-side wall having a concave shape and the second wall 16 is a suction-side wall having a convex shape. The walls 14, 16 connect together at opposed edges to form a leading edge 18 and a trailing edge 20 of the airfoil 10. The walls 14, 16 are generally elongated terminate in at least one platform that is used to mount the airfoil 10 to a component of a turbine engine. In the embodiment of FIG. 1, an inner diameter platform 22 and an outer diameter platform 24 are provided.

Figure 4:
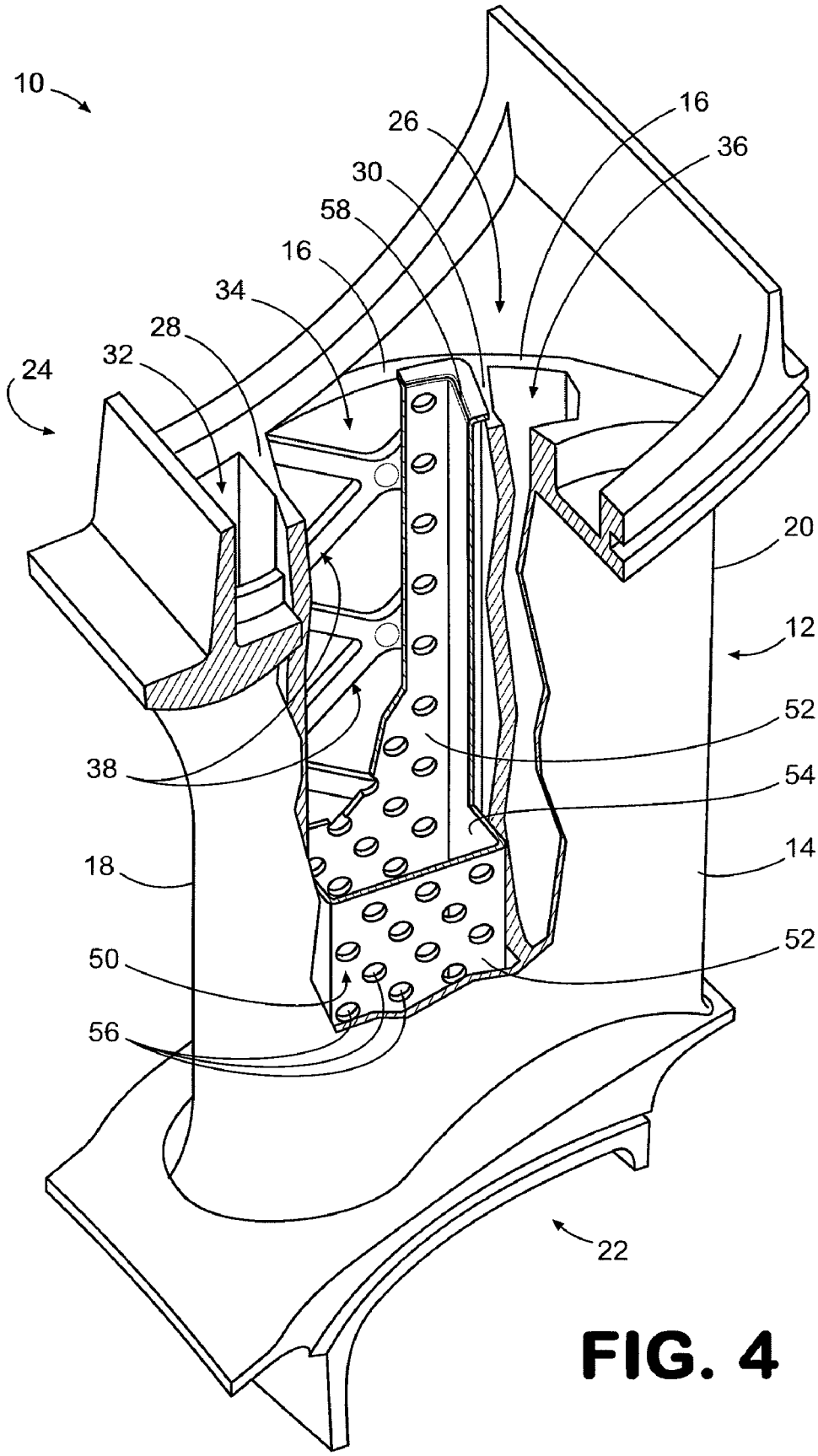
FIG. 4 is a further cutaway perspective view of the airfoil of FIG. 1, illustrating the positioning of the baffle shown in FIG. 3, which is also shown in cutaway view.

As is further indicated in FIG. 1, the first and second walls 14, 16 define a core that forms a hollow interior space 26 through which cooling air can flow. In the embodiment of FIG. 1, first and second longitudinal ribs 28 and 30 are provided within the interior space 26 that extend between and connect the first and second walls 14, 16 to provide structural integrity to the airfoil 10. The longitudinal ribs 28, 30 divide the interior space 26 of the airfoil 10 into three different longitudinal hollow compartments, including a first or front compartment 32, a second or middle compartment 34, and a third or rear compartment 36. Provided within the middle compartment 34 is a plurality of reinforcement members 38 that reduce or prevent the walls 14, 16 of the airfoil 10 from bulging outward into the gas path of the engine in which the airfoil is used. As indicated in FIG. 4, the reinforcement members 38 extend to and connect the longitudinal ribs 28, 30. In the embodiment of FIG. 1, the reinforcement members 38 are arranged in a vertical (in the orientation of FIG. 1) row that extends within the interior space 26 along a length of the body 12. Notably, although reinforcement members 38 are only shown on the wall 16 in the view of FIG. 1, similar reinforcement members can be provided on wall 14.

In some embodiments, the airfoil 10 is composed of a metal material (e.g., alloy) and is formed using a casting process. In other embodiments, the airfoil 10 is composed of a ceramic material and is formed using a casting process. In still other embodiments, the airfoil 10 is composed of a composite material and is formed using an injection molding process.

Figure 2:
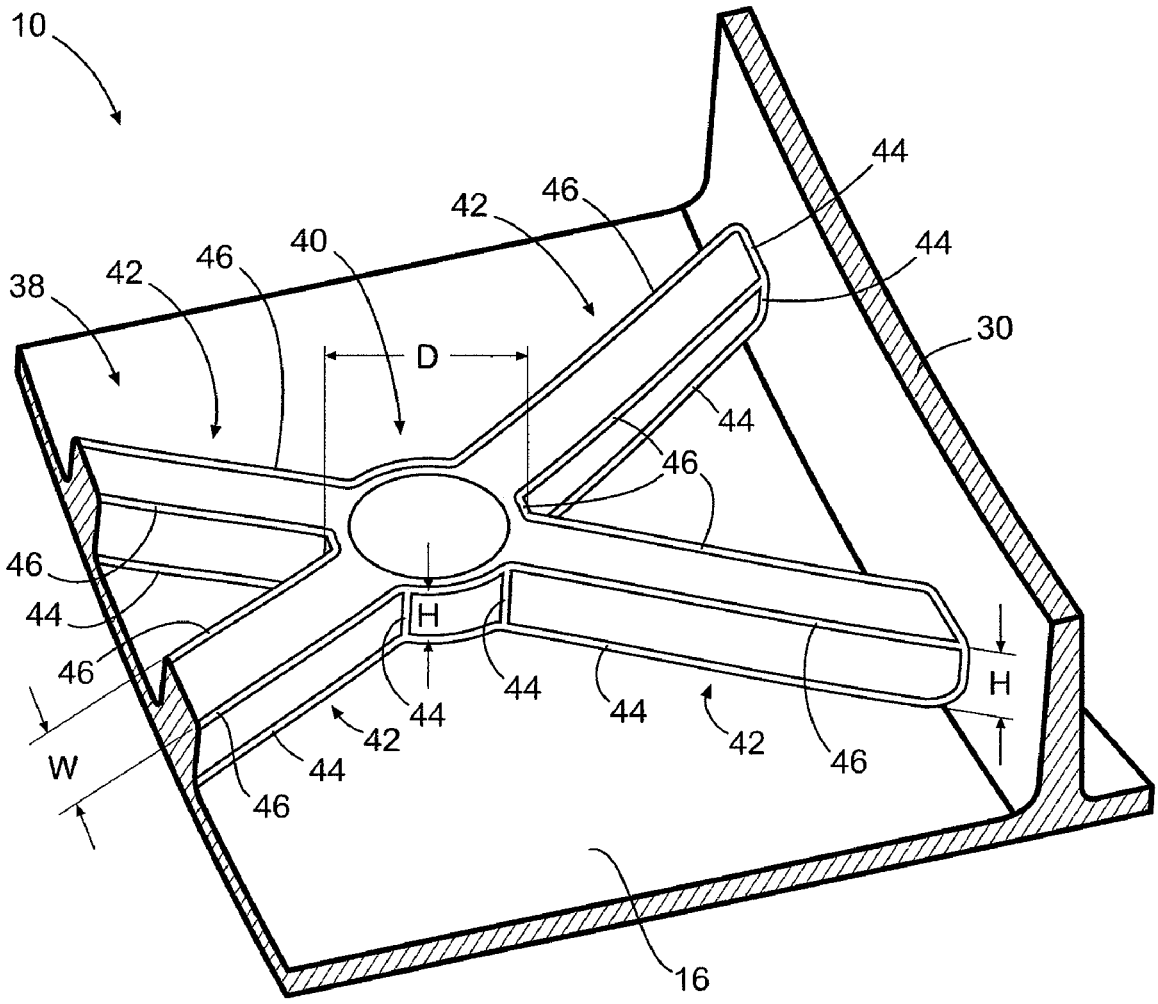
FIG. 2 is a partial perspective view of the airfoil of FIG. 1, illustrating a reinforcement member of the airfoil.

FIG. 2 illustrates a single reinforcement member 38 provided on one of the walls (i.e., wall 16) of the airfoil 10. In the embodiment of FIG. 2, the reinforcement member 38 takes the form of an X-shaped girder formed on the wall 16 that extends between the longitudinal ribs 28, 30 (only rib 30 visible in FIG. 2). The reinforcement member 38 is defined by a generally circular central portion 40 from which extend multiple elongated arms cross braces or beams 42 that extend in a transverse direction across an inner surface. In the illustrated embodiment, four cross beams 42 are provided, with two cross beams extending to each longitudinal rib 28, 30 (FIG. 1). In some embodiments, the central portion 40 is positioned on the wall 16 approximately halfway between the longitudinal ribs 28, 30 (FIG. 1) and the cross beams 42 are approximately equal in length.

Irrespective of their particular shape and configuration, the central portion 40 and the cross beams 42 provide increased thickness (i.e., cross-section) to the wall 16 at discrete areas that resists deformation of the wall so as to reduce or avoid bulge. Optimal dimensions for the central portion 40 and the cross beams depend upon the particular application and can, for example, 42 be mathematically determined through finite element analysis.

From the above it can be appreciated that the reinforcement members 38 do not comprise components that extend between and connect the walls 14, 16 of the airfoil 10. Instead, the reinforcement members 38 comprise discrete members that extend inwardly from the inner surfaces of the walls 14, 16 only a finite distance to a limited degree to increase the thickness, and therefore strength, of the walls.

In some embodiments, the reinforcement members 38 are formed with the airfoil walls during the formation of the airfoil such that the reinforcement members and the walls on which the reinforcement members are provided are unitarily formed the same continuous piece of material. Such construction is contrasted with the addition of the reinforcement members 38 to the walls of the airfoil after the walls have already been formed. In some embodiments, the reinforcement members 38 are directly cast or injection molded with the airfoil walls.

The central portion 40 is provided to avoid the provision of sharp corners that could cause and/or propagate cracks at the location at which the cross beams meet. As is apparent from FIG. 2, the reinforcement member 38 further forms no sharp corners with the airfoil wall or its longitudinal ribs. Instead, fillets (i.e., rounded corners) 44 are provided at the interfaces between the central portion 40 and the airfoil wall 16, between the central portion and the arms 42, and between the arms and both the airfoil walls and the longitudinal ribs 28, 30. In addition, rounded corners 46 are provided at the top edges of each of the central portion 40 and the cross beams 42.

Figure 3:
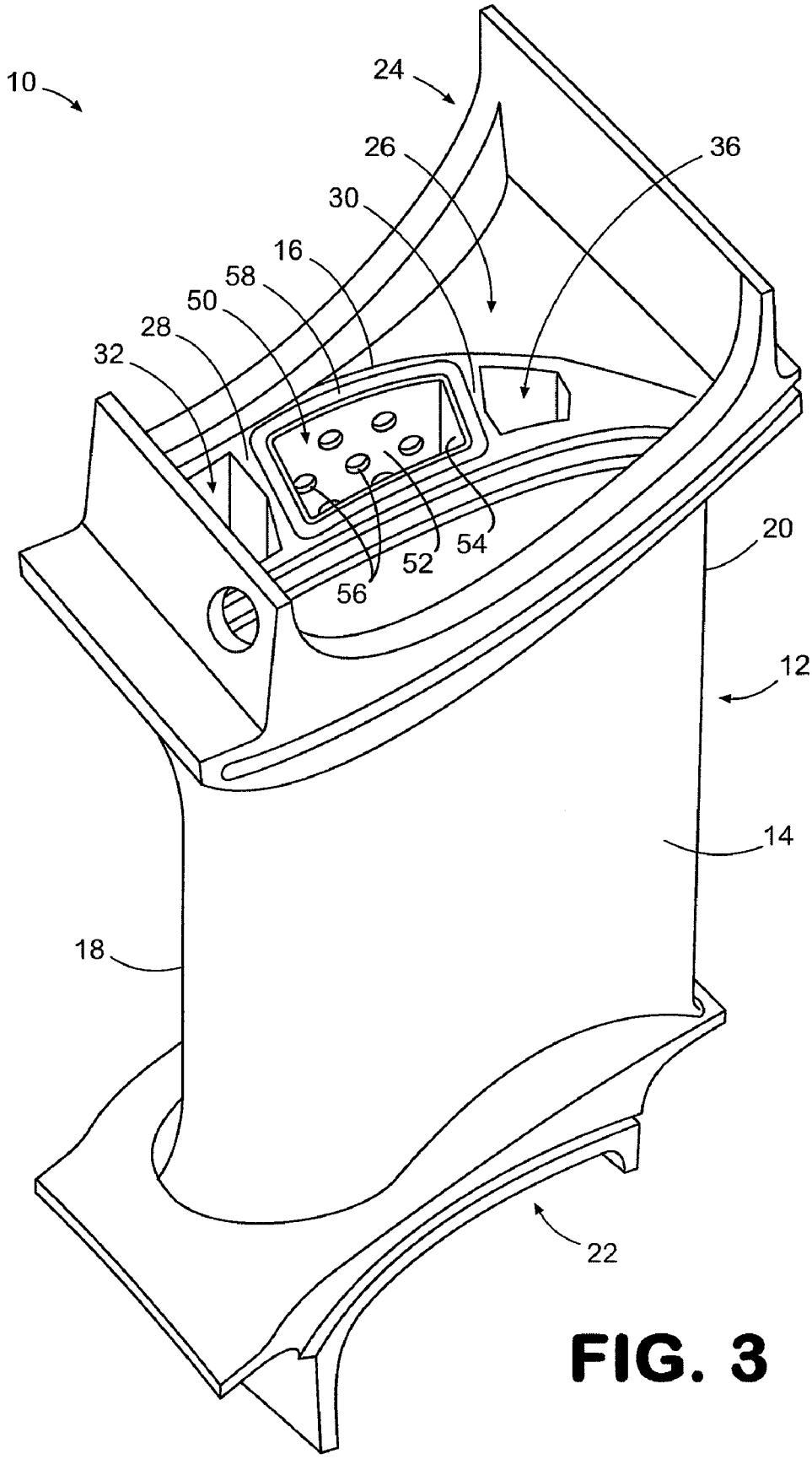
FIG. 3 is a perspective view of the airfoil of FIG. 1 with a baffle provided within the interior of the airfoil.

FIGS. 3 and 4 illustrate the airfoil 10 of FIG. 1 with a baffle 50 provided within the interior space 26. Notably, the provision of such a baffle 50 is made possible by the absence of auxiliary longitudinal ribs that could be positioned between the longitudinal ribs 28, 30. The baffle 50 is provided within the middle compartment 34 of the interior space 26 between the longitudinal ribs 28, 30 (FIG. 4). The baffle 50 comprises an elongated, hollow member having a rectangular cross-section that is defined by lateral walls 52 and end walls 54. In the embodiment of FIGS. 3 and 4, the lateral walls 52 comprise a plurality of openings 56 that are used to direct cooling air toward the inner surfaces of the airfoil walls 14, 16. As is apparent in both FIGS. 3 and 4, the baffle 50 includes at least one end flange 58 that contacts the ends of one or more of the walls 14, 16 and the longitudinal ribs 28, 30.

Figure 5:
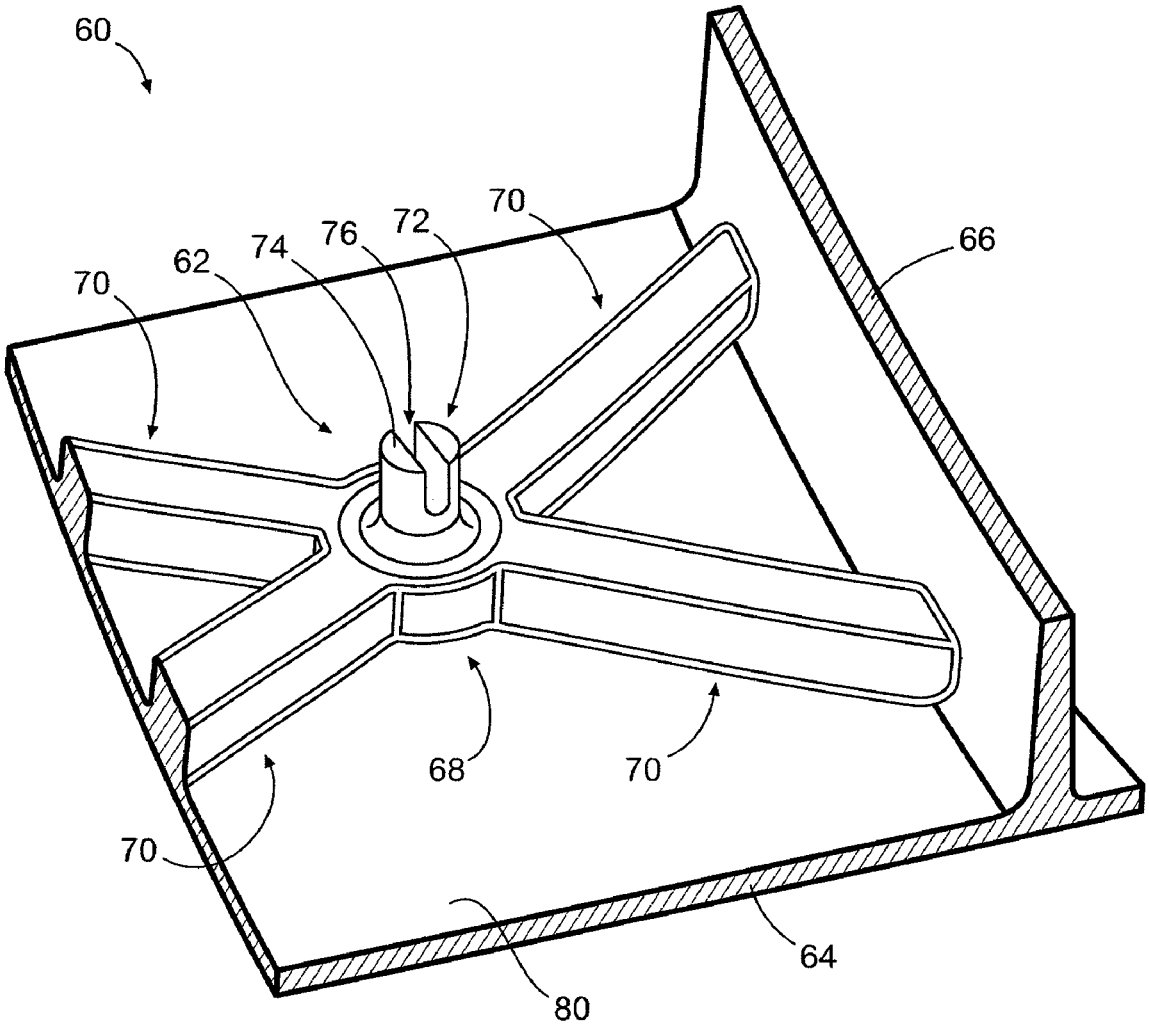
FIG. 5 is a partial perspective view of another reinforced airfoil, illustrating an alternative reinforcement member.

FIG. 5 is a partial perspective view of another reinforced airfoil 60 that illustrates an alternative reinforcement member 62. The reinforcement member 62 is similar to the reinforcement member 38 shown in FIG. 2. Therefore, as indicated in FIG. 5, the reinforcement member 62 takes the form of an X-shaped girder formed on an airfoil wall 64 that extends between longitudinal ribs of the airfoil 60 (only rib 66 visible in FIG. 5). Although an X-shape is illustrated in FIG. 5 and described herein, it is to be understood that alternative shapes can be used. For instance, the reinforcement members 62 can comprise a Y-shape, T-shape, I-shape or any other shape or configuration that provides the desired degree of reinforcement. The reinforcement member 62 shown in FIG. 5 includes a generally circular central portion 68 from which extend multiple elongated cross braces or beams 70. In the embodiment of FIG. 5, however, the reinforcement member 62 includes a stand-off 72 that extends from the central portion 68. As indicated in FIG. 5, the stand-off 72 comprises an elongated protrusion that extends away from the airfoil wall 64. In the embodiment of FIG. 5, the stand-off 72 comprises a generally planar baffle engagement surface 74 that is bifurcated by a groove or slot 76 that extends downward along the length of the stand-off toward the airfoil wall 64.

Figure 6:
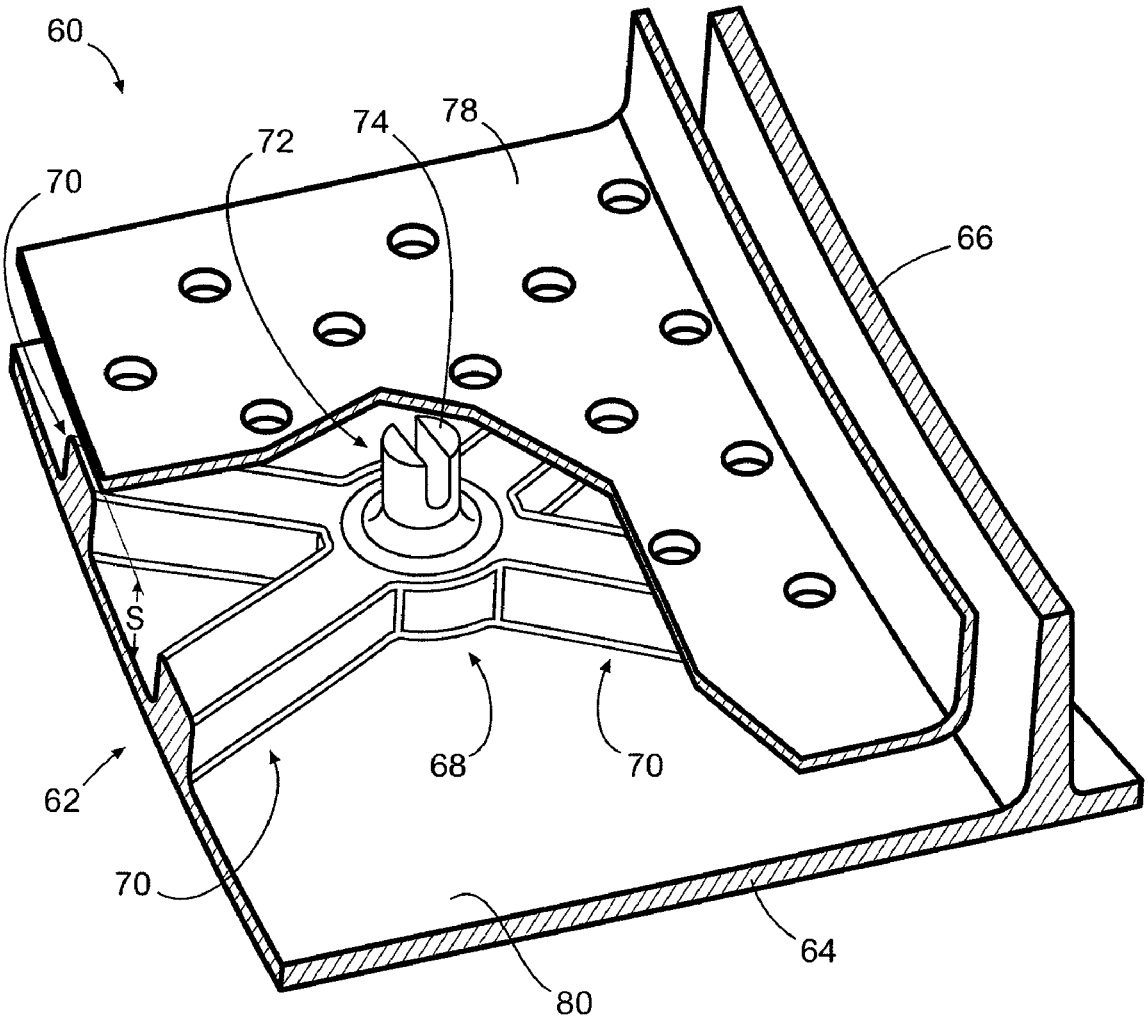
FIG. 6 is a partial perspective view of the reinforced airfoil of FIG. 5 in use with a baffle.

In use, the stand-off 72 acts as a spacer that maintains a desired spacing between a baffle and the airfoil wall 64 on which the reinforcement member 62 is provided. Such functionality is illustrated in FIG. 6. As shown in that figure, a baffle 78 is provided that abuts the baffle engagement surface 74 such that a desired amount of spacing, S, is maintained between the baffle and the inner surface 80 of the wall 64. Due to the provision of the slot 76, the cross-sectional area of the stand-off 72 is reduced so as to reduce impedance of the flow of cooling air through the airfoil 60. It is noted that a stand-off need not be provided in the center of the reinforcement member 62. In other embodiments, one of more stand-offs may, in addition or in exception, extend from one or more of the cross beams 70. Moreover, any reinforcement member 62 may comprise a plurality of stand-offs instead of just one as illustrated in FIGS. 5 and 6. It is further noted that stand-offs are not required in all embodiments. For instance, stand-offs may be omitted in cases in which compartmentalization of the interior space 26 is desired.

Figure 7:
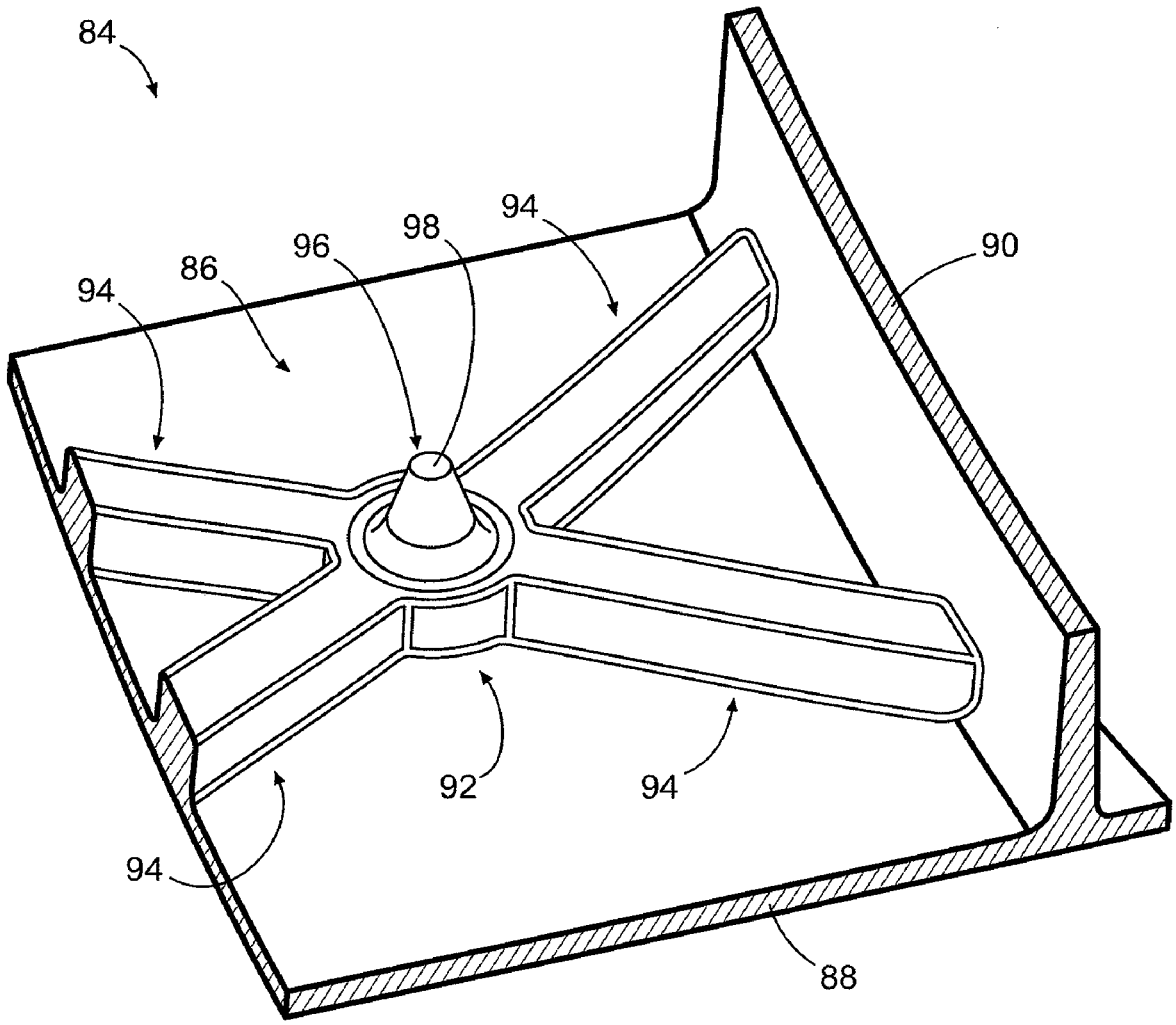
FIG. 7 is a partial perspective view of a further reinforced airfoil, illustrating a further alternative reinforcement member.

FIG. 7 is a partial perspective view of another reinforced airfoil 84 that illustrates an alternative reinforcement member 86. The reinforcement member 86 is also similar to the reinforcement member 38 shown in FIG. 2 and therefore also takes the form of an X-shaped girder formed on an airfoil wall 88 that extends between longitudinal ribs of the airfoil 84 (only rib 90 visible in FIG. 5). The reinforcement member 86 includes a generally circular central portion 92 from which extend multiple elongated cross braces or beams 94. In the embodiment of FIG. 7, however, the reinforcement member 86 includes a baffle stand-off 96 that extends from the central portion 92. As indicated in FIG. 7, the stand-off 96 comprises a generally frustoconical member that includes a planar baffle engagement surface 98.

Like the stand-off 72, the stand-off 96 acts as a spacer that maintains a desired spacing between a baffle and the airfoil wall 88 on which the reinforcement member 86 is provided. Due to the frustoconical shape of the stand-off 96, the cross-sectional area of the stand-off is reduced so as to reduce impedance of the flow of cooling air through the airfoil 84.

The invention claimed is:

1. A reinforced airfoil comprising:

an airfoil body including opposed walls;

a first and second longitudinal rib which extend between and connect the first and second walls to define a hollow interior space; and a reinforcement member provided on at least one of the walls within the interior space, the reinforcement member defines an increased thickness of the at least one wall so as to resist deformation of the at least one wall, the reinforcement member defined by a generally circular central portion from which extend cross beams that connect the first and second longitudinal rib.

2. The airfoil of claim 1, wherein the central portion and the cross beams form an X-shaped girder that connect the first and second longitudinal ribs.

3. The airfoil of claim 1, further comprising a baffle provided within the interior space between the first and second longitudinal ribs.

4. The airfoil of claim 3, wherein the reinforcement member includes a baffle stand-off that maintains a desired degree of spacing between the baffle and the at least one wall, the baffle stand-off extends from the generally circular central portion.

5. A reinforced airfoil comprising:

an airfoil body including opposed first and second walls;

a first and second longitudinal rib which extend between and connect the first and second walls to define a hollow interior space;

multiple reinforcement members formed on inner surfaces of the first and second walls within the interior space between the longitudinal ribs to increase the thickness of the first and second walls at discrete locations so as to resist deformation of the walls during use of the airfoil, the reinforcement member defined by a generally circular central portion from which extend cross beams that connect the first and second longitudinal rib;

a baffle within the hollow interior space; and a baffle stand-off that maintains a desired degree of spacing between the baffle and the first and second walls, the baffle stand-off extends from the generally circular central portion.

6. The airfoil of claim 5, wherein the reinforcement members further include a central portion from which the cross beams extend.

7. The airfoil of claim 6, wherein the reinforcement members comprise fillets at connection points between the cross beams and the central portion.

8. The airfoil of claim 6, wherein the reinforcement members comprise fillets at connection points between the cross beams and longitudinal ribs.

9. The airfoil of claim 6, wherein the central portion and the cross beams form an X-shaped girder that connect the first and second longitudinal ribs.

10. A reinforced airfoil for a turbine engine, the airfoil comprising:

an airfoil body including opposed first and second walls, the walls defining a hollow interior space and including first and second ends;

at least one platform connected to one of the first and second ends of the first and second walls;

first and second longitudinal ribs provided within the interior space of the airfoil body, the longitudinal ribs extending along a length of the airfoil body and further extending between and connecting the first and second walls, the longitudinal ribs defining a middle compartment of the interior space;

a plurality of reinforcement members unitarily formed with the first and second walls and provided on inner surfaces of the walls within the middle compartment, the reinforcement members being arranged in a row on each wall that extends along the length of the airfoil body within the interior space, each reinforcement member including a central portion from which extend cross beams, wherein the cross beams extend and connect to the longitudinal ribs, the reinforcement member defined by a generally circular central portion from which extend cross beams that connect the first and second longitudinal ribs to form an X-shaped girder;

a baffle within the hollow interior space between the first and second longitudinal ribs;

a baffle stand-off that maintains a desired degree of spacing between the baffle and the first and second walls, the baffle stand-off extends from the generally circular central portion.

11. The airfoil of claim 10, wherein the reinforcement members comprise fillets at connection points between the cross beams and the inner surfaces of the first and second walls and between the cross beams and longitudinal ribs.

12. The airfoil of claim 10, wherein the central portion and the cross beams form an X-shaped girder that connect the first and second longitudinal ribs.

13. The airfoil of claim 10, wherein the reinforcement members further include a baffle stand-off that maintains a desired degree of spacing between a baffle and the first and second walls.

14. The airfoil of claim 4, wherein the baffle comprises an elongated, hollow member having a rectangular cross-section defined by lateral walls and end walls, the lateral walls include a plurality of openings to direct cooling air toward the inner surfaces of the airfoil walls.

15. The airfoil of claim 14, wherein the reinforcement member forms no sharp corners.

16. The airfoil of claim 14, further comprising fillets at connections between the cross beams and the inner surfaces of the first and second walls and between the cross beams and longitudinal ribs.

17. The airfoil of claim 16, further comprising rounded corners at the top edges of each of the central portion and the cross beams.

18. The airfoil of claim 5, wherein the baffle stand-off includes a generally frustoconical member that includes a planar baffle engagement surface.

19. The airfoil of claim 5, wherein the baffle stand-off includes a generally planar baffle engagement surfaces bifurcated by a slot.

20. The airfoil of claim 19, wherein the slot decreases the cross-sectional area of the stand-off to reduce impedance of the flow of cooling air through the airfoil.

* * * * *